US010538094B2

(12) United States Patent
Kubo et al.

(10) Patent No.: US 10,538,094 B2
(45) Date of Patent: Jan. 21, 2020

(54) LIQUID EJECTION HEAD

(71) Applicant: CANON KABUSHIKI KAISHA, Tokyo (JP)

(72) Inventors: Koichi Kubo, Yokohama (JP); Naozumi Nabeshima, Tokyo (JP); Soji Kondo, Yokohama (JP); Kazuya Yoshii, Yokohama (JP); Noriyasu Nagai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/023,369

(22) Filed: Jun. 29, 2018

(65) Prior Publication Data

US 2019/0009560 A1 Jan. 10, 2019

(30) Foreign Application Priority Data

Jul. 5, 2017 (JP) ..... 2017-131777

(51) Int. Cl.
*B41J 2/175* (2006.01)
*B41J 2/14* (2006.01)

(52) U.S. Cl.
CPC .. *B41J 2/17563* (2013.01); *B41J 2002/14403* (2013.01)

(58) Field of Classification Search
CPC .. B41J 2/17563; B41J 2/14024; B41J 2/1404; B41J 2/1753; B41J 2/18; B41J 2202/12; B41J 2202/20
See application file for complete search history.

(56) References Cited

U.S. PATENT DOCUMENTS

| | | | | |
|---|---|---|---|---|
| 7,556,362 | B2 | 7/2009 | Akahane | |
| 8,454,140 | B2 | 6/2013 | Kondo | |
| 9,962,937 | B2 | 5/2018 | Okushima et al. | |
| 10,022,979 | B2 | 7/2018 | Okushima et al. | |
| 2008/0266370 | A1* | 10/2008 | Haines | B41J 2/17513 347/93 |
| 2011/0304678 | A1* | 12/2011 | Yamamoto | B41J 2/175 347/93 |
| 2014/0292933 | A1* | 10/2014 | Hagiwara | B41J 2/17563 347/47 |
| 2015/0251435 | A1* | 9/2015 | Miyajima | B41J 2/17563 347/93 |

(Continued)

FOREIGN PATENT DOCUMENTS

| | | | |
|---|---|---|---|
| JP | 2014-141032 | A | 8/2014 |
| WO | 2005/075202 | A1 | 8/2005 |

*Primary Examiner* — Huan H Tran
(74) *Attorney, Agent, or Firm* — Venable LLP

(57) ABSTRACT

A liquid ejection head includes a pressure adjusting mechanism that communicates with a supply flow path that supplies a liquid to an element substrate including an ejection port ejecting a liquid, and adjusts a pressure of the liquid flowing in the supply flow path, a pressure adjusting mechanism that communicates with a collection flow path that collects a liquid from the element substrate, and adjusts a pressure of the liquid flowing in the collection flow path, and a filter storage chamber including therein a filter that captures foreign matter in the liquid. Further, the liquid ejection head includes upstream flow paths and a connection section that causes the upstream flow paths to communicate with each other, and is provided downstream of the filter.

12 Claims, 13 Drawing Sheets

(56) References Cited

U.S. PATENT DOCUMENTS

| | | | | |
|---|---|---|---|---|
| 2015/0314607 | A1* | 11/2015 | Moriguchi | B05B 7/24 347/85 |
| 2017/0197409 | A1 | 7/2017 | Okushima et al. | |
| 2017/0197419 | A1 | 7/2017 | Dkushima et al. | |
| 2017/0274647 | A1 | 9/2017 | Aoki et al. | |
| 2018/0043688 | A1 | 2/2018 | Okushima et al. | |
| 2019/0001690 | A1 | 1/2019 | Nagai et al. | |
| 2019/0001691 | A1 | 1/2019 | Inada et al. | |
| 2019/0001697 | A1 | 1/2019 | Yamada et al. | |
| 2019/0009541 | A1 | 1/2019 | Kondo et al. | |
| 2019/0009543 | A1 | 1/2019 | Yoshii et al. | |

* cited by examiner

LIQUID EJECTION HEAD

BACKGROUND OF THE INVENTION

Field of the Invention

The present disclosure relates to a liquid ejection head that ejects a liquid.

Description of the Related Art

On a liquid ejection head that is used in a liquid ejection apparatus such as a recording apparatus, element substrates each including an ejection port that ejects a liquid are mounted. In a liquid ejection head like this, control is generally performed so that a negative pressure is applied to a liquid that is held in an ejection port. As a generation source of the negative pressure, a water head difference between a liquid level of a tank communicating with the ejection port and a liquid level of the ejection port is usually used.

When a position of the liquid level of the tank changes in the liquid ejection head as described above, the water head difference changes in accordance with the change of the position, and with this, the negative pressure which is applied to the liquid in the ejection port varies. When the negative pressure varies, a position of a surface of a meniscus that is formed in the ejection port changes due to a capillary phenomenon, and as a result, a volume of the liquid which is ejected varies. When the volume of the liquid which is ejected varies, density unevenness and the like occur, and there is a risk that the quality of the recorded image may be affected.

In relation with this, International Publication No. WO2005/075202 discloses an art of restraining variation in the surface positions of the meniscuses of the ejection ports by providing two pressure adjusting mechanisms in the liquid supply route of the liquid ejection head, and by the respective pressure adjusting mechanisms independently controlling the pressure of the liquid. In this art, it is necessary to add a water pressure to the pressure adjusting mechanisms to control the negative pressure, and in order to enhance precision of the negative pressure control, it is necessary to restrain the variation of the water pressure which is applied to the pressure adjusting mechanisms.

Further, in recent years, recording apparatuses including liquid ejection heads have been required to have higher resolution. Japanese Patent Application Laid-Open No. 2014-141032 describes an art capable of improving resolution by suppressing poor ejection due to increase in viscosity of the liquid in the ejection ports by causing the liquid to flow so that the liquid does not stay in the ejection ports and the like of the element substrates. In this art, supply flow paths that supply a liquid to the ejection ports, and collection flow paths that collect the supplied liquid are provided, and pressure difference is generated in the respective flow paths, whereby the liquid is caused to flow.

In the art described in Japanese Patent Application Laid-Open No. 2014-141032, the amount of the liquid evaporated from the ejection ports varies when the flow velocity of the liquid flowing into the ejection ports varies, so that the color material density in the liquid varies, and the amount of the color material contained in the liquid which is ejected changes. Further, when the flow velocity of the liquid which flows into the ejection ports varies, the exhaust heat amount from the ejection ports varies, so that the viscosity of the liquid varies, and lack of uniformity occurs to the volume of the liquid which is ejected. When a change in the color material amount, lack of uniformity of the volume and the like occur, the image quality of the recorded image is reduced, so that in order to enhance image quality, it is necessary to restrain a variation of the flow velocity of the liquid that flows into the ejection ports.

In the case of the structure in which the liquid is caused to flow by the differential pressure between the two flow paths, the flow velocity of the liquid which flows into the ejection ports changes in accordance with the pressure difference between the supply flow path and the collection flow path, so that in order to restrain the variation in the flow velocity, it is necessary to keep the pressure difference between the supply flow path and the collection flow path in a fixed range.

In order to control the pressure difference, it is conceivable to apply the art described in International Publication No. WO2005/075202, but the art has the problem as follows.

In the art described in International Publication No. WO2005/075202, the two pressure adjusting mechanisms each individually includes a fluid path for supplying a liquid and a filter for removing impurities in the liquid. Consequently, due to the variations in the flow rates of the liquid which flows in the flow paths to the respective pressure adjusting mechanisms from a pressure source, the pressure losses that occur in the respective flow paths and the filters vary, and a difference occurs to the pressures which are applied to the respective pressure adjusting mechanisms. Consequently, control of the pressure adjusting mechanism becomes unstable, it is difficult to keep the pressure difference between the supply flow path and the collection flow path in a fixed range, and it is difficult to restrain the variation in the flow velocity of the liquid which flows into the ejection ports.

SUMMARY OF THE INVENTION

The present disclosure is made in the light of the above described problem, and has an object to provide a liquid ejection head capable of suppressing a variation in a flow velocity of a liquid that flows into ejection ports.

A liquid ejection head according to the present disclosure includes an element substrate including an ejection port ejecting a liquid, a supply flow path that supplies a liquid to the element substrate, a collection flow path that collects a liquid from the element substrate, a first pressure adjusting mechanism that communicates with the supply flow path, and adjusts a pressure of a liquid flowing in the supply flow path, a second pressure adjusting mechanism that communicates with the collection flow path and adjusts a pressure of a liquid flowing in the collection flow path, a filter storage chamber including therein a filter that captures a foreign matter included in a liquid, a first upstream flow path that communicates with the first pressure adjusting mechanism, and supplies a liquid to the first pressure adjusting mechanism, a second upstream flow path that communicates with the second pressure adjusting mechanism and supplies a liquid to the second pressure adjusting mechanism, and a connection section that causes the first upstream flow path and the second upstream flow path to communicate with each other, wherein the connection section is provided at a downstream side from the filter.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Hereinafter, embodiments of the present disclosure will be described with reference to the drawings. Note that components having the same functions in the respective drawings will be assigned with the same reference signs, and explanation of the components may be omitted.

First Embodiment

Figure 1:
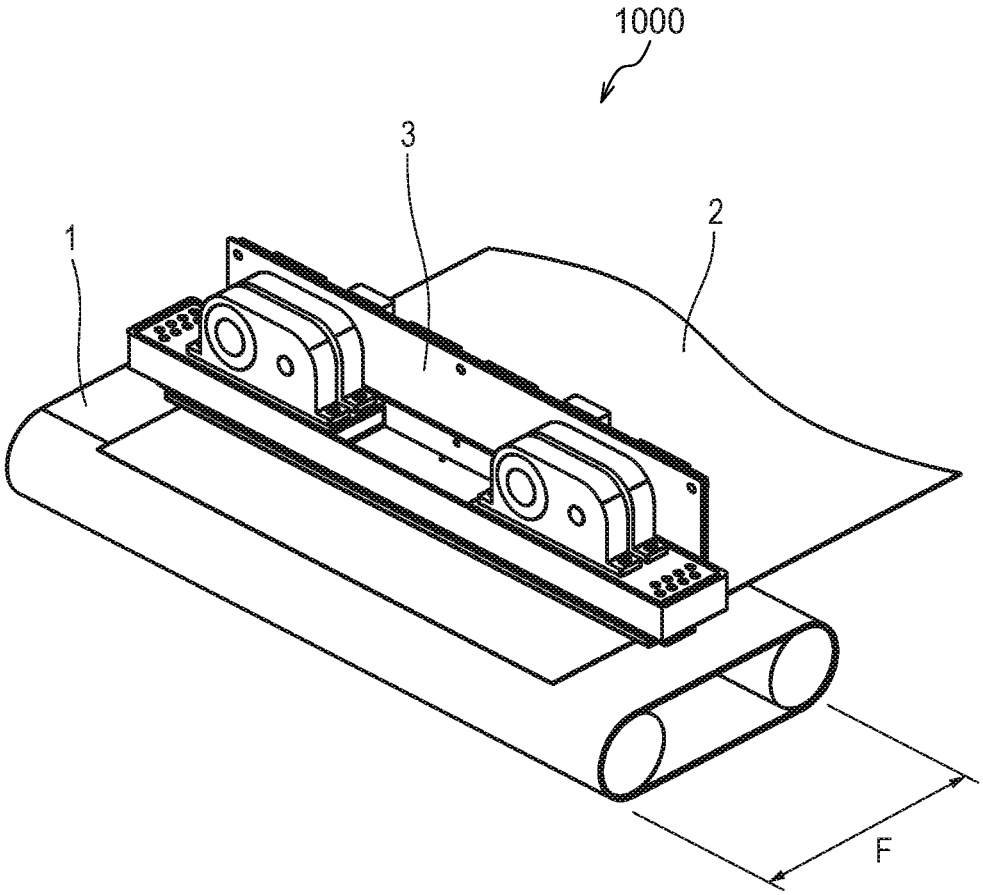
FIG. 1 is a view illustrating a schematic construction of a liquid ejection apparatus according to a first embodiment of the present disclosure.

FIG. 1 illustrates a schematic construction of a liquid ejection apparatus according to the first embodiment of the present disclosure. The liquid ejection apparatus illustrated in FIG. 1 is an inkjet recording apparatus 1000 (hereinafter, also referred to as a recording apparatus) that performs recording by ejecting ink as a liquid. The recording apparatus 1000 is a page-wide type (line type) recording apparatus. That is, the recording apparatus 1000 includes a conveying section 1 that conveys a recording medium 2, and a page-wide type (line type) liquid ejection head 3 that is disposed substantially orthogonally to a conveying direction of the recording medium 2, and performs continuous recording by one-pass while continuously or intermittently conveying the recording medium 2. The recording medium 2 may be a cut sheet, or may be a continuous roll sheet. The liquid ejection head 3 is capable of full-color printing by using CMYK (cyan, magenta, yellow and black) inks as the liquids. Further, a liquid supply unit that is a supply path that supplies a liquid to the liquid ejection head 3 as described later, a main tank, and a buffer tank (refer to FIG. 2) are fluidly connected to the liquid ejection head 3. Further, an electric control unit that transmits electric power and a logic signal to the liquid ejection head 3 is electrically connected to the liquid ejection head 3. A liquid route and an electric signal route in the liquid ejection head 3 will be described later.

(Explanation of First Circulation Route)

Figure 2:
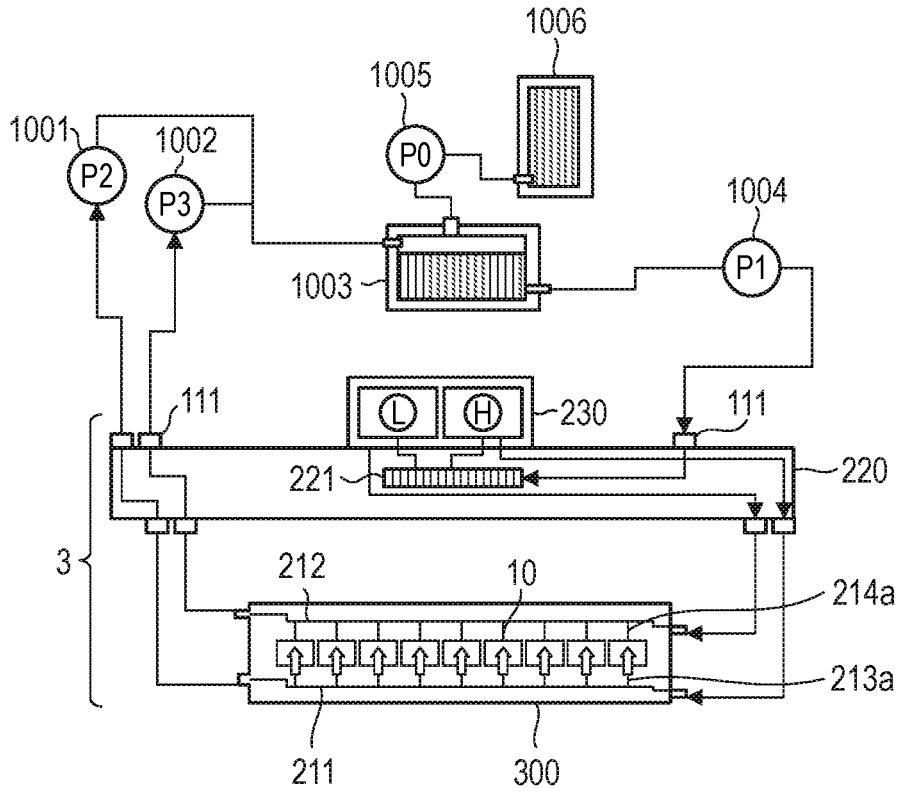
FIG. 2 is a schematic view illustrating a circulation route according to the first embodiment of the present disclosure.

A circulation route circulating a liquid, which is applied to the recording apparatus 1000 of the present embodiment, will be described. FIG. 2 is a schematic view illustrating one mode of a circulation route which is applied to the recording apparatus 1000. In FIG. 2, the liquid ejection head 3 is fluidly connected to a first circulation pump (high pressure side) 1001, a first circulation pump (low pressure side) 1002, a buffer tank 1003 and the like. Note that FIG. 2 illustrates only a route in which an ink of one color of CMYK inks flows to simplify explanation, but in reality, circulation routes for four colors are provided in the liquid ejection head 3 and the recording apparatus main unit 1000.

The buffer tank 1003 used as a sub tank is connected to a main tank 1006. The buffer tank 1003 has an air communication hole (not illustrated) that allows an inside and an outside of the tank to communicate with each other, and is capable of discharging air bubbles in the ink to the outside. The buffer tank 1003 is further connected to a replenishing pump 1005. The replenishing pump 1005 transfers a consumed amount of ink to the buffer tank 1003 from the main tank 1006 when the liquid is consumed in the liquid ejection head 3 by the operation of ejecting or discharging the liquid from the ejection ports of the liquid ejection head 3. As the operation of ejecting or discharging the liquid, a recording operation, a suction recovery operation and the like are cited, for example.

The two first circulation pumps 1001 and 1002 have a function of extracting a liquid from the liquid connection section 111 of the liquid ejection head 3 to cause the liquid to flow to the buffer tank 1003. As the first circulation pump, a positive displacement pump having a quantitative liquid delivering ability is preferable. Specifically, as the first circulation pump, a tube pump, a gear pump, a diaphragm pump, a syringe pump and the like are cited, and a pump of a mode of ensuring a fixed flow rate by arranging an ordinary fixed flow rate valve or a relief valve in a pump outlet, for example, may be adopted. A fixed amount of liquid flows inside of each of a common supply flow path 211 and a common collection flow path 212 by the first circulation pump (high pressure side) 1001 and the first circulation pump (low pressure side) 1002 at a time of drive of the liquid ejection head 3. The flow rate of the liquid is preferably set at or over such a rate that temperature difference among respective recording element substrates 10 in the liquid ejection head 3 does not affect image quality of the recorded image. However, when an excessively large flow rate is set, a negative pressure difference becomes so large in the respective recording element substrates 10 that image density unevenness occurs, due to the influence of the pressure loss in the flow paths in the liquid ejection unit 300. Consequently, it is preferable to set the flow rate with a temperature difference and a negative pressure difference among the respective recording element substrates 10 taken into consideration.

A negative pressure control unit 230 is provided on a route between a second circulation pump 1004 and the liquid ejection unit 300. The negative pressure control unit 230 operates to keep a pressure at a downstream side from the negative pressure control unit 230 within a fixed range with a desired pressure set in advance as a center, even when the flow rate in the circulation route varies due to a difference in recording duty (Duty). The downstream side from the negative pressure control unit 230 refers to a side closer to the liquid ejection unit 300 than the negative pressure control unit 230. The negative pressure control unit 230 includes two pressure adjusting mechanisms to which different control pressures from each other are set. As the two pressure adjusting mechanisms, any mechanism is not particularly limited as long as it can control pressures downstream of the pressure adjusting mechanisms themselves to a variation in a fixed range or less with a desired set pressure as a center. For the pressure adjusting mechanism, for example, a so-called "pressure reducing regulator" can be used. When the pressure reducing regulator is used as the pressure adjusting mechanism, it is preferable to pressurize an upstream side of the negative pressure control unit 230 via the liquid supply unit 220 by the second circulation pump 1004 as illustrated in FIG. 2. In this case, an influence of a water head on the liquid ejection head 3, of the buffer tank 1003 can be suppressed, so that a degree of freedom of layout of the buffer tank 1003 in the recording apparatus 1000 can be increased. The second circulation pump 1004 may be any pump that has a lift pressure of a fixed pressure or more in a range of an ink circulation flow rate that is used at a time of drive of the liquid ejection head 3, and a turbo type pump, a positive displacement pump and the like can be used. Specifically, as the second circulation pump 1004, a diaphragm pump or the like is applicable. Further, it is also possible to apply, for example, a water head tank that is disposed to have a predetermined water head difference to the negative pressure control unit 230, in place of the second circulation pump 1004.

Of the two pressure adjusting mechanisms, a mechanism at a relatively high-pressure set side, and a mechanism at a relatively low-pressure set side are respectively connected to the common supply flow path 211 and the common collection flow path 212 in the liquid ejection unit 300 via the inside of the liquid supply unit 220. The mechanism at the relatively high-pressure set side is denoted by H in FIG. 2, and the mechanism at the relatively low-pressure set side is denoted by L in FIG. 2. In the liquid ejection unit 300, an individual supply flow path 213*a* and an individual collection flow path 214*a* that communicate with the common supply flow path 211, the common collection flow path 212 and the respective recording element substrates are provided. The individual supply flow paths 213*a* and the individual collection flow paths 214*a* communicate with the common supply flow path 211 and the common collection flow path 212. Consequently, flows (arrows in FIG. 2) in which part of the liquid that flows in the common supply flow path 211 passes through internal flow paths of the recording element substrates 10 from the common supply flow path 211 and flows into the common collection flow path 212 are generated. This is because a differential pressure occurs between the two common flow paths (the common supply flow path 211 and the common collection flow path 212) because the pressure adjusting mechanism H at the high-pressure set side is connected to the common supply flow path 211, and the pressure adjusting mechanism L at the low-pressure set side is connected to the common collection flow path 212.

As mentioned above, in the liquid ejection unit 300, the flows in which a part of the liquid passes through the insides of the respective recording element substrates 10 are generated while the liquid is allowed to flow to pass through the insides of the common supply flow path 211 and the common collection flow path 212, respectively. Consequently, heat that is generated in the respective recording element substrates 10 can be discharged outside of the recording element substrates 10 by the liquid flowing through the common supply flow path 211 and the common collection flow path 212. Further, by this construction, when recording by the liquid ejection head 3 is performed, flows of liquid can also be generated in ejection ports and pressure chambers that do not perform recording, so that increase in viscosity of the ink in those sites can be suppressed. Further, the liquid increased in viscosity and foreign matters in the liquid can be discharged to the common collection flow path 212. Consequently, the liquid ejection head 3 is capable of recording at a high speed with high image quality.

(Explanation of Liquid Ejection Head Structure)

Figure 3A:
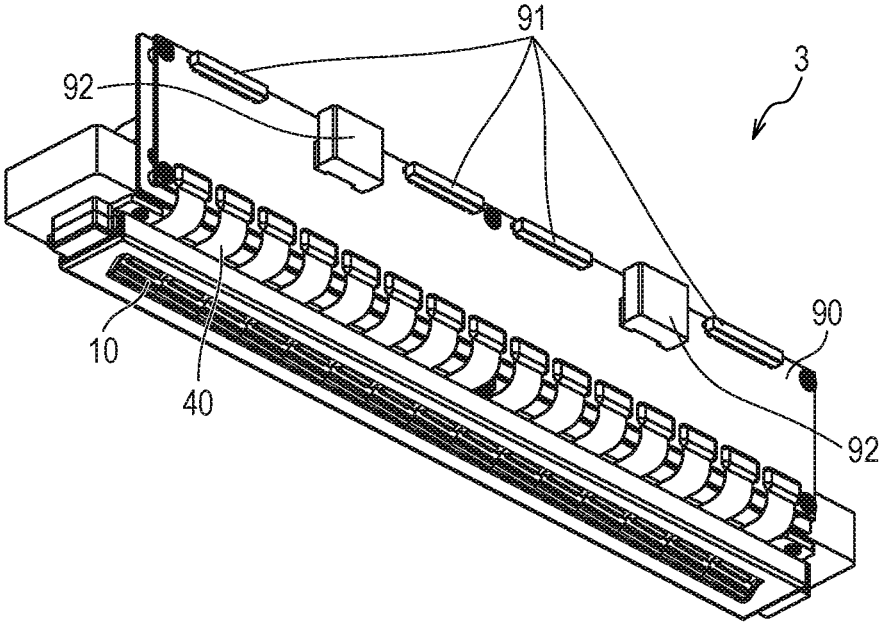
FIGS. 3A and 3B are perspective views illustrating a schematic structure of a liquid ejection head according to the first embodiment of the present disclosure.
Figure 3B:
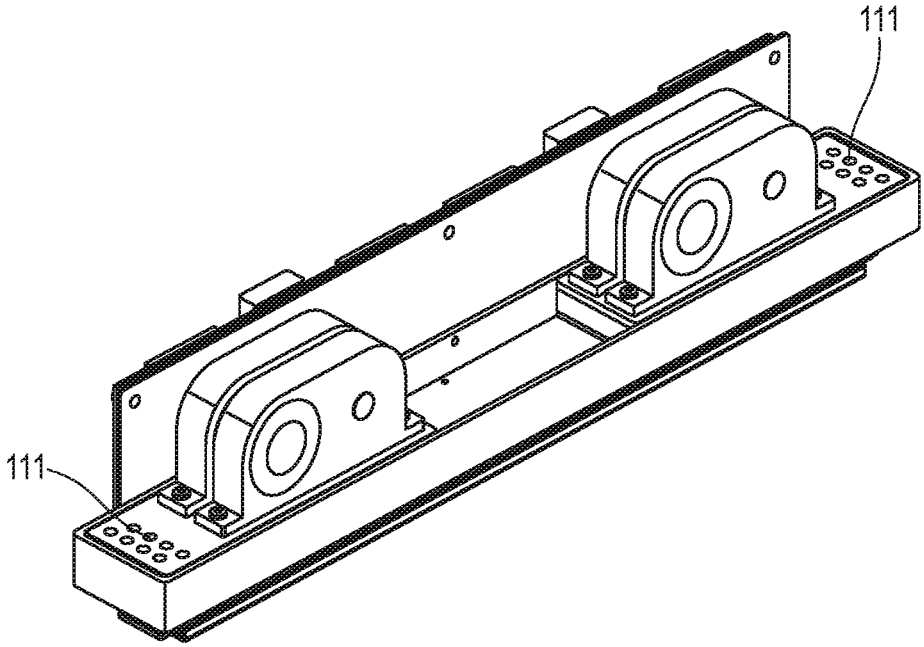

A structure of the liquid ejection head 3 will be described. FIGS. 3A and 3B are perspective views of the liquid ejection head 3. The liquid ejection head 3 is a page-wide type (line type) liquid ejection head in which a plurality (more specifically, 15) of recording element substrates 10 capable of ejecting inks of four colors of CMYK in each of the recording element substrates 10 are arranged on a straight line. As illustrated in FIG. 3A, the liquid ejection head 3 includes signal input terminals 91 and electric power supply terminals 92 that are electrically connected to the respective recording element substrates 10 via flexible wiring boards 40 and an electric wiring board 90. The signal input terminals 91 and the electric power supply terminals 92 are electrically connected to a control section (not illustrated) of the recording apparatus 1000, and respectively supply logic signals and electric power necessary for ejection to the recording element substrates 10. By concentrating wiring by electric circuits in the electric wiring board 90, numbers of the signal input terminals 91 and electric power supply terminals 92 can be decreased as compared with the number of recording element substrates 10. Thereby, the number of electric connection sections that need to be detached and attached at a time of assembly of the liquid ejection head 3 or at a time of replacement of the liquid ejection head 3 can be decreased. As illustrated in FIG. 3B, liquid connection sections 111 that are provided at both end portions of the liquid ejection head 3 are connected to a liquid supply system of the recording apparatus 1000. Thereby, inks of four colors of CMYK are supplied to the liquid ejection head 3 from the supply system of the recording apparatus 1000, and the inks passing through the inside of the liquid ejection head 3 are collected into the supply system of the recording apparatus 1000. In this way, the inks of the respective colors are capable of circulating via a route of the recording apparatus 1000 and a route of the liquid ejection head 3.

Figure 4:
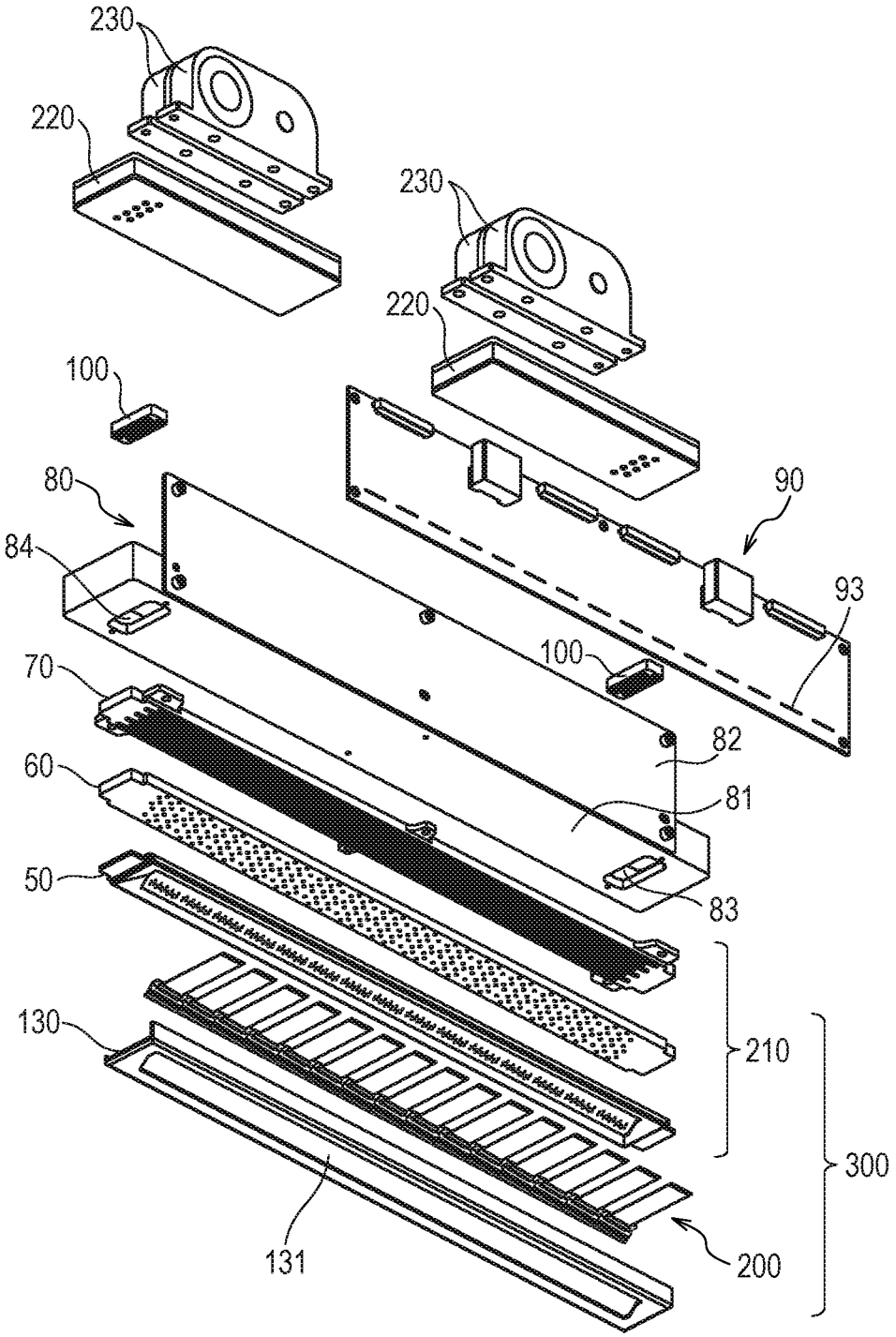
FIG. 4 is an exploded perspective view of the liquid ejection head according to the first embodiment of the present disclosure.

FIG. 4 illustrates an exploded perspective view of respective components or units constructing the liquid ejection head 3. The liquid ejection unit 300, the liquid supply unit 220 and the electric wiring board 90 are attached to an enclosure 80. The liquid connection sections 111 (FIG. 2) are provided in the liquid supply unit 220. Further, a filter 221 (FIG. 2) for each color that communicates with each opening of the liquid connection section 111 is provided inside the liquid supply unit 220, to capture (remove) foreign matters in the ink which is supplied. The filters 221 for four colors are provided in the liquid supply unit 220. The liquids that pass through the filter 221 are supplied to the negative pressure control unit 230 that is disposed on the liquid supply unit 220 correspondingly to the respective colors. The negative pressure control unit 230 is a unit including a pressure adjusting valve for each color. The negative pressure control unit 230 greatly attenuates, by operations of a valve, a spring member and the like provided inside of each of the units, a change in pressure loss in the supply system (a supply system at an upstream side of the liquid ejection head 3) of the recording apparatus 1000, which occurs with a variation in the flow rate of the liquid. Thereby, a negative pressure change at a downstream side (a liquid ejection unit 300 side) from the negative pressure control unit 230 can be stabilized to be within a certain fixed range. In the negative pressure control unit 230 of the respective colors, the two pressure adjusting valves are contained for each color as illustrated in FIG. 2 and are respectively set to different control pressures. The high pressure side of the negative pressure control unit 230 communicates with the common supply flow path 211 in the liquid ejection unit 300 via the liquid supply unit 220, and the low pressure side communicates with the common collection flow path 212 via the liquid supply unit 220.

The enclosure 80 is constructed by a liquid ejection unit supporting section 81 and an electric wiring board supporting section 82, supports the liquid ejection unit 300 and the electric wiring board 90, and ensures rigidity of the liquid ejection head 3. The electric wiring board supporting section 82 is for supporting the electric wiring board 90, and is fixed to the liquid ejection unit supporting section 81 by screwing. In the liquid ejection unit supporting section 81, openings 83, 84, 85, 86 to which joint rubbers 100 are inserted are provided. The liquid supplied from the liquid supply unit 220 is guided to a third flow path member 70 constructing the liquid ejection unit 300 via the joint rubbers.

The liquid ejection unit 300 includes a plurality of ejection modules 200 and the flow path member 210, and a cover member 130 is attached to a surface on a recording medium side of the liquid ejection unit 300. Here, the cover member 130 is a member having a frame-shaped surface provided with an elongate opening 131 as illustrated in FIG. 4, and from the opening 131, the recording element substrates 10 and sealer parts 110 (FIG. 8A) included in the ejection modules 200 are exposed. A frame portion around the opening 131 has a function as an abutting surface of a capping member that caps the liquid ejection head 3 at a recording standby time. Consequently, a closed space is preferably formed at a time of capping by applying an adhesive, a sealing material, a filler or the like along a perimeter of the opening 131, and burying recesses and protrusions and gaps on the ejection port surfaces of the liquid ejection unit 300.

Next, a structure of the flow path member 210 included in the liquid ejection unit 300 will be described. As illustrated in FIG. 4, the flow path member 210 is what is formed by stacking a first flow path member 50, a second flow path member 60 and a third flow path member 70. The flow path member 210 distributes the liquid supplied from the liquid supply unit 220 to the respective ejection modules 200, and returns the liquid which returns from the ejection modules 200 to the liquid supply unit 220. The flow path member 210 is fixed to the liquid ejection unit supporting section 81 by screwing, and thereby a warp and deformation of the flow path member 210 are suppressed.

Figure 5A:
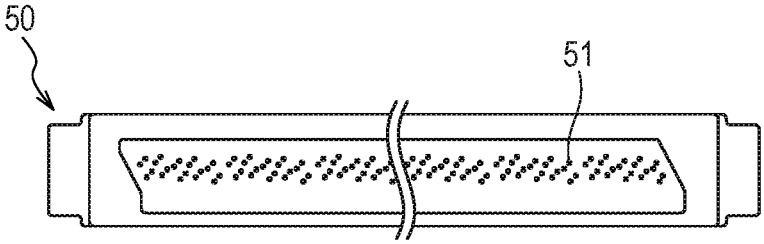
FIGS. 5A, 5B, 5C, 5D, 5E and 5F are surface views of a flow path member according to the first embodiment of the present disclosure.
Figure 5B:
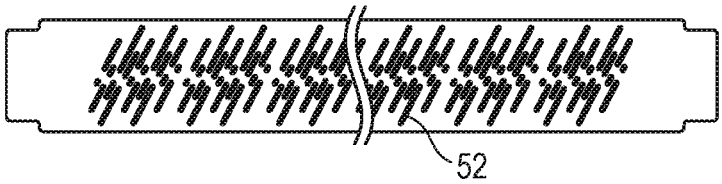
Figure 5C:
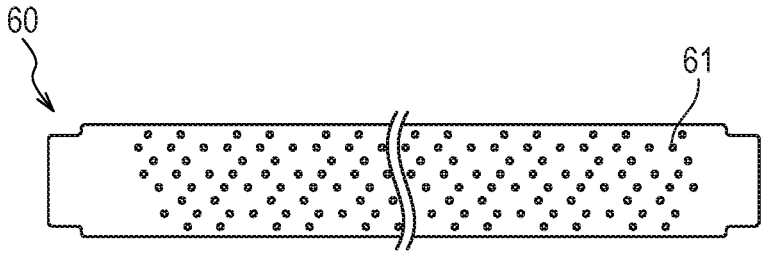
Figure 5D:
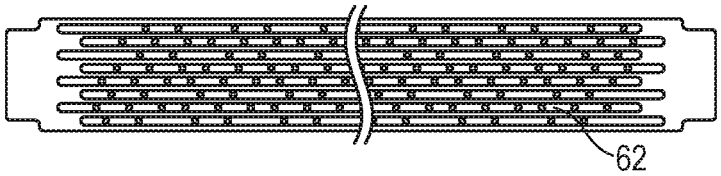
Figure 5E:
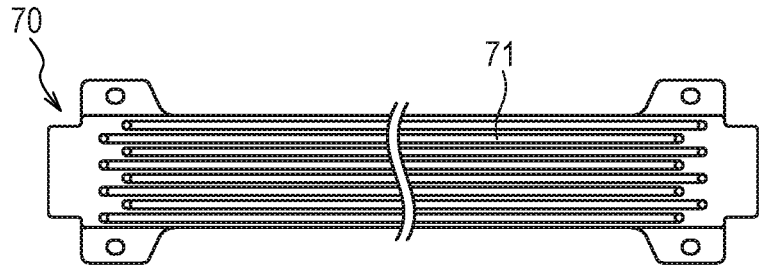
Figure 5F:
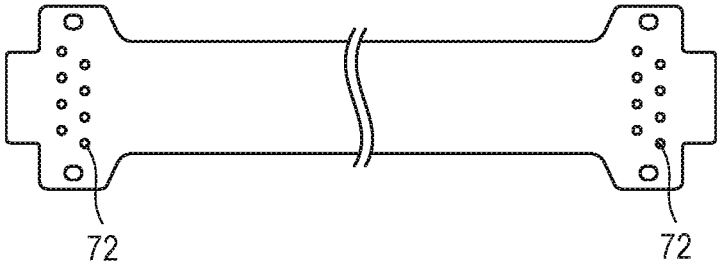
Figure 6:
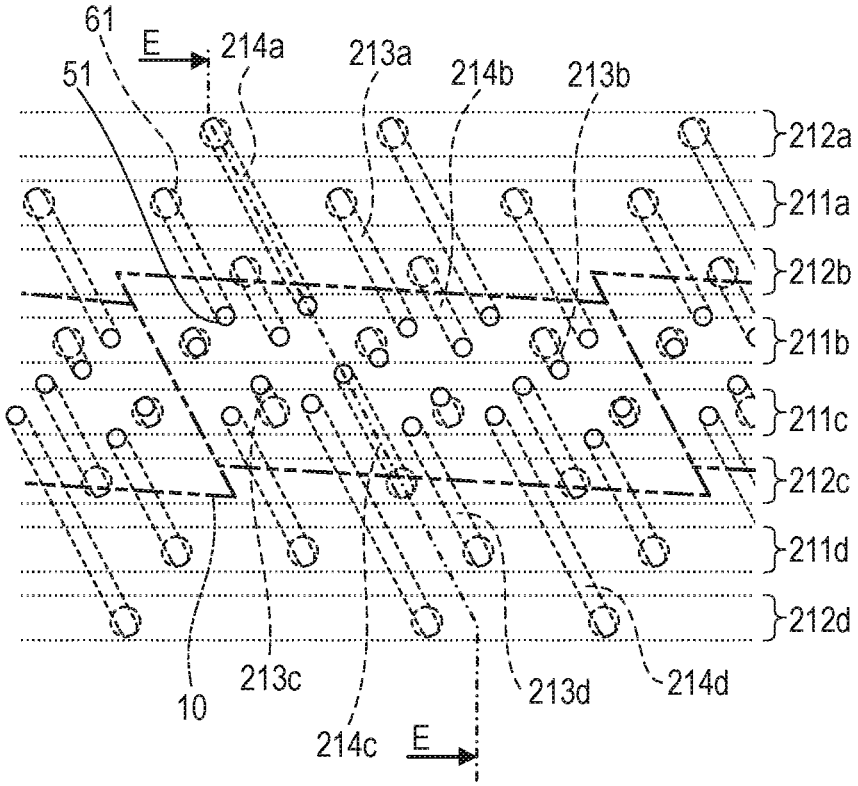
FIG. 6 is an enlarged transparent view of flow paths in the flow path member according to the first embodiment of the present disclosure.

FIGS. 5A to 5F are views that illustrate front surfaces and back surfaces of the respective flow path members of the first to third flow path members. FIG. 5A illustrates a surface on a side where the ejection module 200 is mounted, of the first flow path member 50, and FIG. 5F illustrates a surface on a side abutting on the liquid ejection unit supporting section 81, of the third flow path member 70. The first flow path member 50 and the second flow path member 60 are joined to each other so that abutment surfaces respectively illustrated in FIG. 5B and FIG. 5C face each other, and the second flow path member and the third flow path member are joined to each other so that abutment surfaces respectively illustrated in FIG. 5D and FIG. 5E face each other. When the second flow path member 60 and the third flow path member 70 are joined to each other, eight common flow paths extending in the longitudinal direction of the flow path member are formed by common flow channels 62 and 71 that are formed in the respective second flow path member 60 and third flow path member 70. Thereby, a set of the common supply flow path 211 and the common collection flow path 212 is formed for each color in the flow path member 210 (FIG. 6). Communication ports 72 of the third flow path member 70 communicate with the respective holes of the joint rubber 100, and fluidly communicate with the liquid supply unit 220. A plurality of communication ports 61 are formed on a bottom surface of the common flow channel 62 of the second flow path member 60, and communicate with one end portion of the individual flow channels 52 of the first flow path member 50. Communication ports 51 are formed on the other end portions of the individual flow channels 52 of the first flow path member 50, and fluidly communicate with a plurality of ejection modules 200 via the communication ports 51. The individual flow channels 52 enable flow paths to be concentrated on a center side of the flow path member.

The first to third flow path members 50 to 70 preferably have corrosion resistance to the liquid and are formed from a material with a low linear expansion coefficient. As the material of the first to third flow path members 50 to 70, for example, a composite material (a resin material) formed by using an alumina, LCP (liquid crystal polymer), PPS (polyphenyl sulfide) or PSF (polysulfone) as a base material and adding an inorganic filler is preferable. As the inorganic filler, silica fine particles, fibers and the like are cited. As a forming method of the flow path member 210, the three flow path members may be stacked and joined to one another, or when a resin composite material is selected as the material, a joining method by welding may be used.

Next, with use of FIG. 6, a connection relation of the respective flow paths in the flow path member 210 will be described. FIG. 6 is a transparent view of partially enlarged flow paths in the flow path member 210 which is formed by joining the first to third flow path members, as seen from a side of the surface on which the ejection modules 200 are mounted, of the first flow path member 50. In the flow path member 210, the common supply flow paths 211 (211*a*, 211*b*, 211*c* and 211*d*) and the common collection flow paths 212 (212*a*, 212*b*, 212*c* and 212*d*) which extend in the longitudinal direction of the liquid ejection head 3 are provided for the respective colors. A plurality of individual supply flow paths (213*a*, 213*b*, 213*c* and 213*d*) which are formed by the individual flow channels 52 are connected to the common supply flow paths 211 of the respective colors via the communication ports 61. Further, a plurality of individual collection flow paths (214*a*, 214*b*, 214*c* and 214*d*) which are formed by the individual flow channels 52 are connected to the common collection flow paths 212 of the respective colors via the communication ports 61. By a flow path structure like this, the liquid can be concentrated onto the recording element substrates 10 which are located in a central part of the flow path member from the respective common supply flow paths 211 via the individual supply flow paths 213. Further, the liquid can be collected into the respective common collection flow paths 212 from the recording element substrates 10 via the individual collection flow paths 214.

Figure 7:
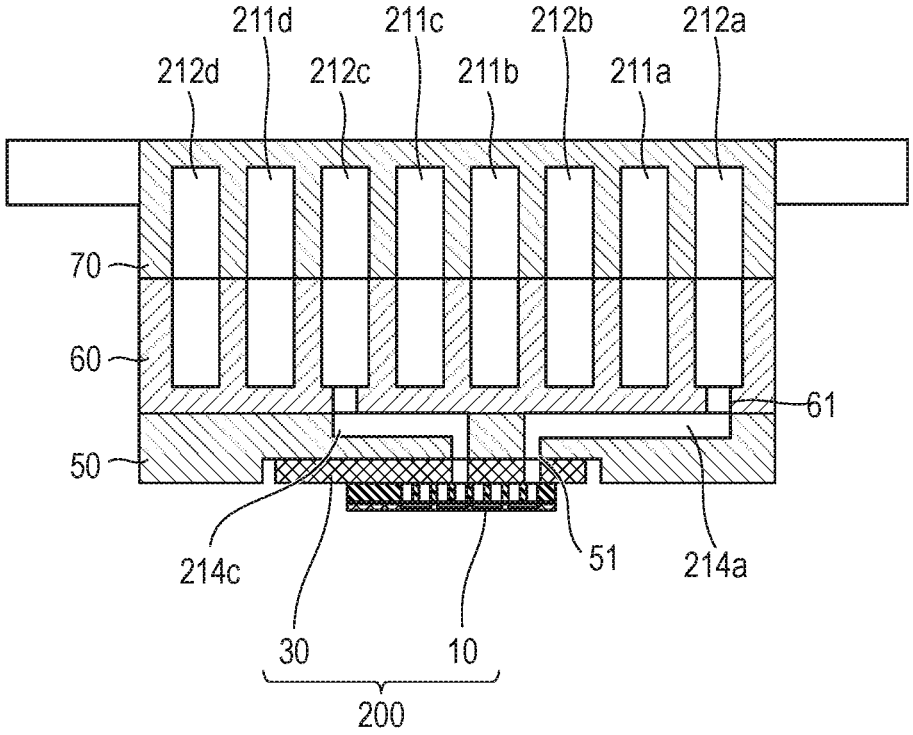
FIG. 7 is a view illustrating a section in line E-E in FIG. 6.

FIG. 7 is a view illustrating a section along line E-E in FIG. 6. As illustrated in FIG. 7, the respective individual collection flow paths 214*a* and 214*c* communicate with the ejection module 200 via the communication ports 51. FIG. 7 illustrates only the individual collection flow paths 214*a* and 214*c*, but in other sections, the other individual supply flow paths 213 and the other individual collection flow paths 214 communicate with the ejection modules 200 as illustrated in FIG. 6. In a support member 30 and the recording element substrate 10 included in each of the ejection modules 200, a flow path for supplying the liquid from the first flow path member 50 to recording elements 15 (FIG. 9B) provided in the recording element substrate 10 is formed. Further, in the support members 30 and the recording element substrates 10 included in the respective ejection module 200, flow paths for collecting (returning) a part or all of the liquid supplied to the recording elements 15 to the first flow path member 50 are formed. Here, the common supply flow paths 211 of the respective colors are connected to the negative pressure control units 230 (the high pressure side) of the corresponding colors via the liquid supply units 220, and the common collection flow paths 212 are connected to the negative pressure control unit 230 (the low pressure side) via the liquid supply units 220. By the negative pressure control unit 230, a differential pressure (a pressure difference) is generated between the common supply flow path 211 and the common collection flow path 212. Consequently, in the liquid ejection head 3 of the present embodiment in which the respective flow paths are connected as illustrated in FIGS. 6 and 7, a flow flowing sequentially to the common supply flow path 211—the individual supply flow path 213*a*—the recording element substrate 10—the individual collection flow path 214*a*—the common collection flow path 212 is generated in each of the colors.

(Explanation of Ejection Module)

Figure 8A:
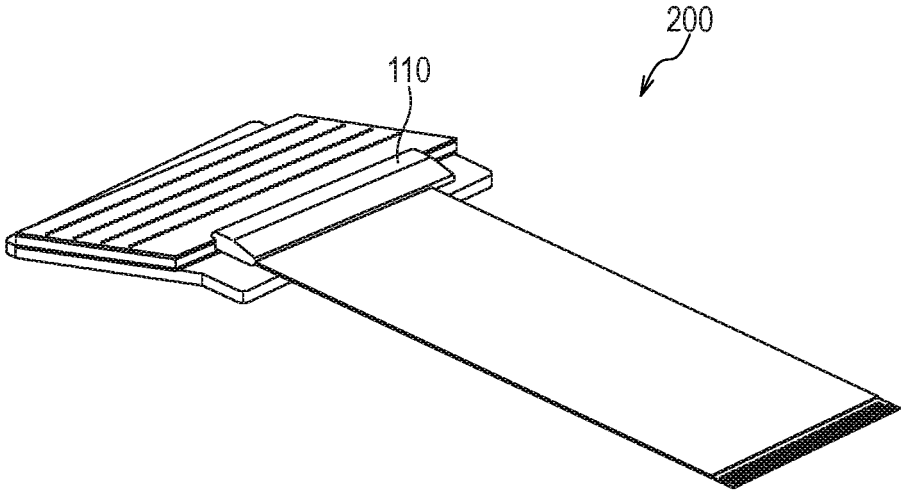
FIGS. 8A and 8B are schematic views illustrating an ejection module according to the first embodiment of the present disclosure.
Figure 8B:
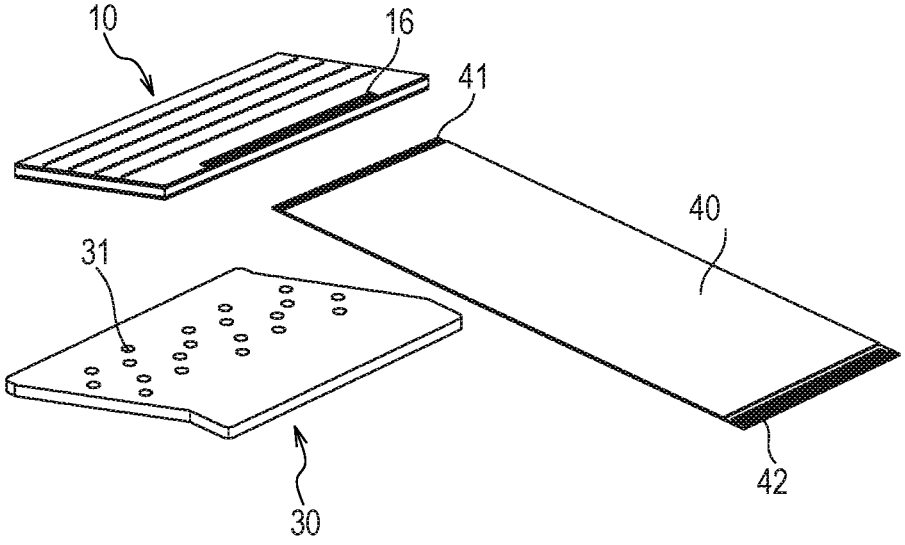

FIG. 8A is a perspective view of one ejection module 200, and FIG. 8B is an exploded view thereof. As a production method of the ejection module 200, the recording element substrate 10 and the flexible wiring board 40 are firstly joined onto the support member 30 which is provided with liquid communication ports 31 in advance. Subsequently, a terminal 16 on the recording element substrate 10 and a terminal 41 on the flexible wiring board 40 are electrically connected by wire bonding, and thereafter, the wire bonding section (an electrically connecting section) is sealed by being covered with a sealer part 110. A terminal 42 of the flexible wiring board 40, at an opposite side from the recording element substrate 10, is electrically connected to a connection terminal 93 (refer to FIG. 4) of the electric wiring board 90. The support member 30 is a supporter that supports the recording element substrate 10 and is also a flow path member that causes the recording element substrate 10 and the flow path member 210 to communicate with each other fluidly, and thereby the support member 30 preferably has a high flatness and can be joined to the recording element substrate with sufficiently high reliability. As the material of the support member 30, for example, an alumina and a resin material are preferable.

(Explanation of Structure of Recording Element Substrate)

Figure 9A:
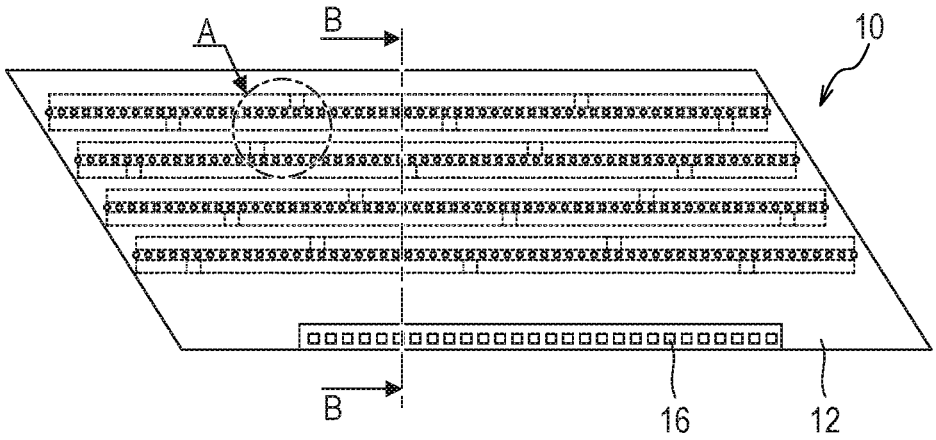
FIGS. 9A, 9B and 9C are plan views of a recording element substrate according to the first embodiment of the present disclosure.

A structure of the recording element substrate 10 in the present application example will be described. FIG. 9A is a plan view of a surface of the recording element substrate 10, at a side where the ejection ports 13 are formed, FIG. 9B is an enlarged view of a part shown by A in FIG. 9A, and FIG. 9C is a plan view of a back surface of FIG. 9A.

As illustrated in FIG. 9A, ejection port arrays in four rows corresponding to the respective ink colors are formed in an ejection port formation member 12 of the recording element substrate 10. Note that hereinafter, a direction, in which the ejection port array where a plurality of ejection ports 13 are arranged extends, will be referred to as an "ejection port array direction".

Figure 9B:
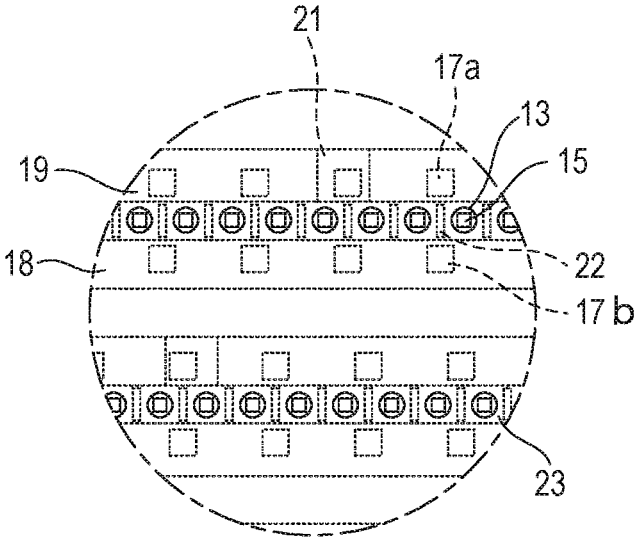

As illustrated in FIG. 9B, in positions corresponding to the respective ejection ports 13, the recording elements 15, which are heating elements for foaming the liquid by thermal energy, are disposed. In the present disclosure, the recording element is not limited to the heating element, but various elements that generate energy which is used to eject a liquid, such as a piezoelectric element, are applicable. Pressure chambers 23 including the recording elements 15 therein are demarcated by partition walls 22. The recording element 15 is electrically connected to a terminal 16 in FIG. 9A by electric wiring (not illustrated) provided in the recording element substrate 10. The recording element 15 boils the liquid by generating heat based on a pulse signal that is input via the electric wiring board 90 (FIG. 4) and the flexible wiring board 40 (FIG. 8B) from the control circuit of the recording apparatus 1000 and the liquid is ejected from the ejection port 13 with a force of foaming by the boiling. As illustrated in FIG. 9B, along each of the ejection port arrays, the liquid supply path 18 extends on one side, and the liquid collection path 19 extends on the other side. The liquid supply path 18 and the liquid collection path 19 are flow paths provided in the recording element substrate 10 and extending in the ejection port array direction, and communicate with the ejection ports 13 via supply ports 17*a* and collection ports 17*b*, respectively. The supply port 17*a* is used to supply the liquid to the pressure chamber 23, and the collection port 17*b* is used to collect the liquid from the pressure chamber 23. The liquid in the pressure chamber 23 is circulated between the pressure chamber 23 and an outside via the supply port 17*a* and the collection port 17*b*.

Figure 9C:
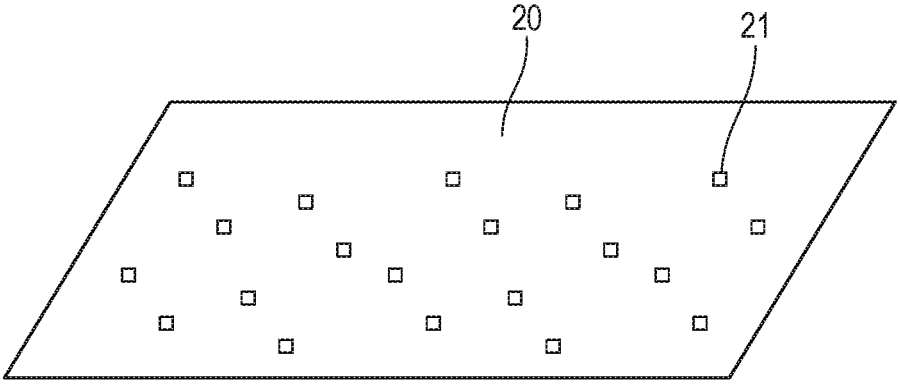
Figure 10:
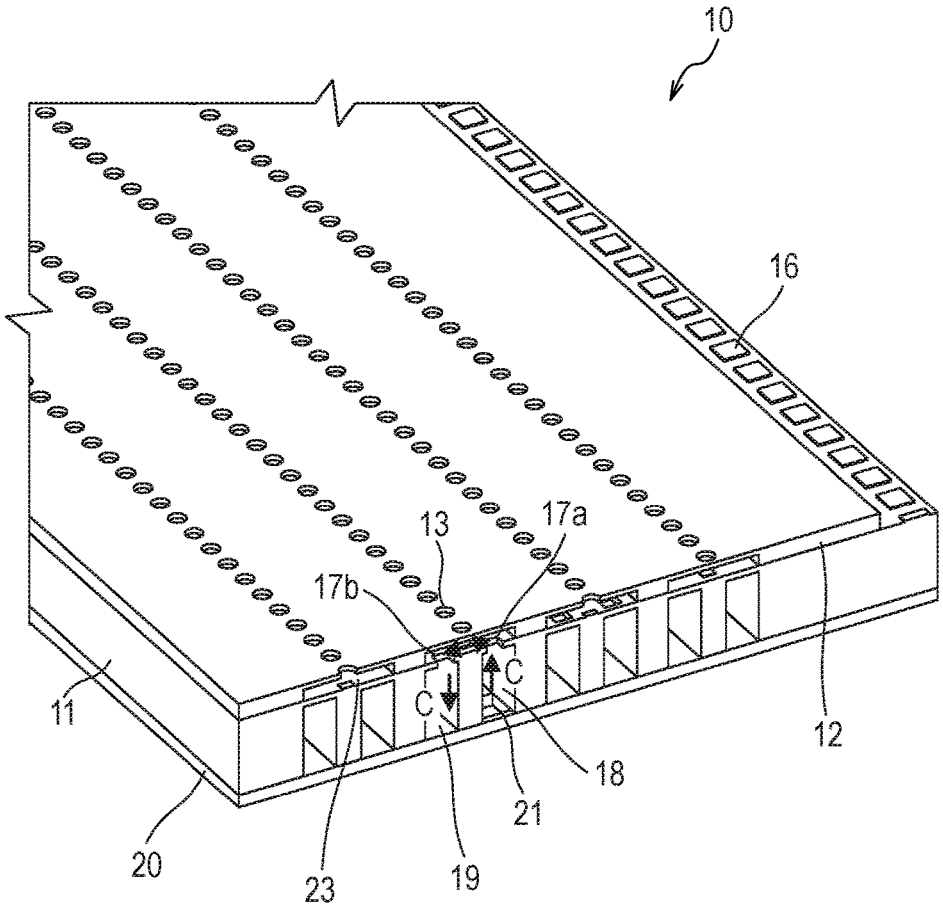
FIG. 10 is a perspective view illustrating a section of a recording element substrate and a lid member in line B-B in FIG. 9A.

As illustrated in FIG. 9C and FIG. 10 (described later), a sheet-shaped lid member 20 is stacked on a back surface of the surface of the recording element substrate 10 where the ejection ports 13 are formed, and a plurality of openings 21 that communicate with the liquid supply path 18 and the liquid collection path 19 (described later) are provided in the lid member 20. In the present application example, the three openings 21 are provided for each liquid supply path 18, and the two openings 21 are provided for each liquid collection path 19 in the lid member 20. As illustrated in FIG. 9B, the respective openings 21 in the lid member 20 communicate with the plurality of communication ports 51 illustrated in FIG. 5A. As illustrated in FIG. 10, the lid member 20 has a function as a lid that forms part of walls of the liquid supply paths 18 and the liquid collection paths 19 formed in the substrate 11 of the recording element substrate 10. The lid member 20 preferably has sufficient corrosion resistance to the liquid, and from the viewpoint of prevention of color mixing, high precision is required of an opening shape and an opening position of the opening 21. Therefore, it is preferable to use a photosensitive resin material and a silicon plate as the material of the lid member 20, and form the openings 21 by a photolithography process. In this way, the lid member 20 converts pitches of the flow paths by the openings 21, is desirably thin in thickness considering a pressure loss, and is desirably formed of a film-shaped member.

Next, a flow of the liquid in the recording element substrate 10 will be described. FIG. 10 is a perspective view illustrating sections of the recording element substrate 10 and the lid member 20 along line B-B in FIG. 9A. In the recording element substrate 10, the substrate 11 formed from Si and the ejection port formation member 12 formed from a photosensitive resin are stacked, and the lid member 20 is joined to a back surface of the substrate 11. The recording elements 15 are formed on one surface side of the substrate 11 (FIG. 10), and on a back surface side of the substrate 11, grooves constructing the liquid supply paths 18 and the liquid collection paths 19 that extend along the ejection port array are formed. The liquid supply path 18 and the liquid collection path 19, which are formed by the substrate 11 and the lid member 20, are respectively connected to the common supply flow path 211 and the common collection flow path 212 in the flow path member 210, and a differential pressure is generated between the liquid supply path 18 and the liquid collection path 19. When recording is performed by ejecting the liquid from the plurality of ejection ports 13 of the liquid ejection head 3, in the ejection port 13 that does not perform ejection, the liquid in the liquid supply path 18 flows into the liquid collection path 19 via the supply port 17*a*, the pressure chamber 23 and the collection port 17*b* by the differential pressure. By the flow (a flow shown by the arrow C in FIG. 10) of the liquid, ink with increased viscosity that is generated by evaporation from the ejection port 13, bubbles, foreign matters and the like in the ejection port 13 that does not perform ejection and the corresponding pressure chamber 23 can be collected into the liquid collection path 19. Further, increase in viscosity of the ink in the ejection port 13 and the pressure chamber 23 can be suppressed. The liquid that is collected into the liquid collection path 19 is collected through the communication ports 51, the individual collection flow path 214 and the common collection flow path 212 in the flow path member 210 in this order through the openings 21 of the lid member 20 and the liquid communication ports 31 of the support member 30 (refer to FIG. 8B). Subsequently, the liquid is finally collected into the supply route of the recording apparatus 1000.

That is, the liquid which is supplied to the liquid ejection head 3 from the recording apparatus main unit 1000 flows in the following order, and is supplied and collected. The liquid flows to the inside of the liquid ejection head 3 from the liquid connection section 111 of the liquid supply unit 220 first. Subsequently, the liquid is supplied to the joint rubber 100, the communication ports 72 and the common flow channel 71 provided in the third flow path member, the common flow channel 62 and the communication ports 61 provided in the second flow path member, and the individual flow channel 52 and the communication ports 51 provided in the first flow path member in this order. Thereafter, the liquid is supplied to the pressure chamber 23 sequentially through the liquid communication ports 31 provided in the support member 30, the openings 21 provided in the lid member, and the liquid supply paths 18 and the supply ports 17*a* provided in the substrate 11. Of the liquids which are supplied to the pressure chambers 23, the liquid which is not ejected from the ejection port 13 flows sequentially in the collection ports 17*b* and the liquid collection path 19 which are provided in the substrate 11, the openings 21 provided in the lid member and the liquid communication ports 31 provided in the support member 30. Further, the liquid sequentially flows in the communication ports 51 and the individual flow channels 52 which are provided in the first flow path member, the communication ports 61 and the common flow channels 62 which are provided in the second flow path member, the common flow channels 71 and the communication ports 72 which are provided in the third flow path member 70 and the joint rubbers 100. Subsequently, the liquid flows to outside of the liquid ejection head 3 from the liquid connection sections 111 provided in the liquid supply unit. In the first circulation route illustrated in FIG. 2, the liquid which flows in from the liquid connection section 111 is supplied to the joint rubber 100 after passing through the negative pressure control unit 230.

Further, as illustrated in FIG. 2, all of the liquid that flows in from one end of the common supply flow path 211 of the liquid ejection unit 300 is not supplied to the pressure chambers 23 via the individual supply flow paths 213*a*. Some parts of the liquid flow to the liquid supply unit 220 from the other end of the common supply flow path 211 without flowing into the individual supply flow paths 213*a*. In this way, by including the route through which the liquid flows without passing through the recording element substrates 10, a backflow of the circulation flow of the liquid can be suppressed, even in the recording element substrate 10 including flow paths which are very fine and having large flow resistance as in the present application example. In this way, in the liquid ejection head 3 in the present application example, increase in viscosity of the liquid in the vicinities of the pressure chamber 23 and the ejection port 13 can be suppressed, so that misdirection of ejection and mis-ejection can be suppressed, and as a result, a high-resolution image can be recorded.

(Explanation of Positional Relation Among Recording Element Substrates)

Figure 11:
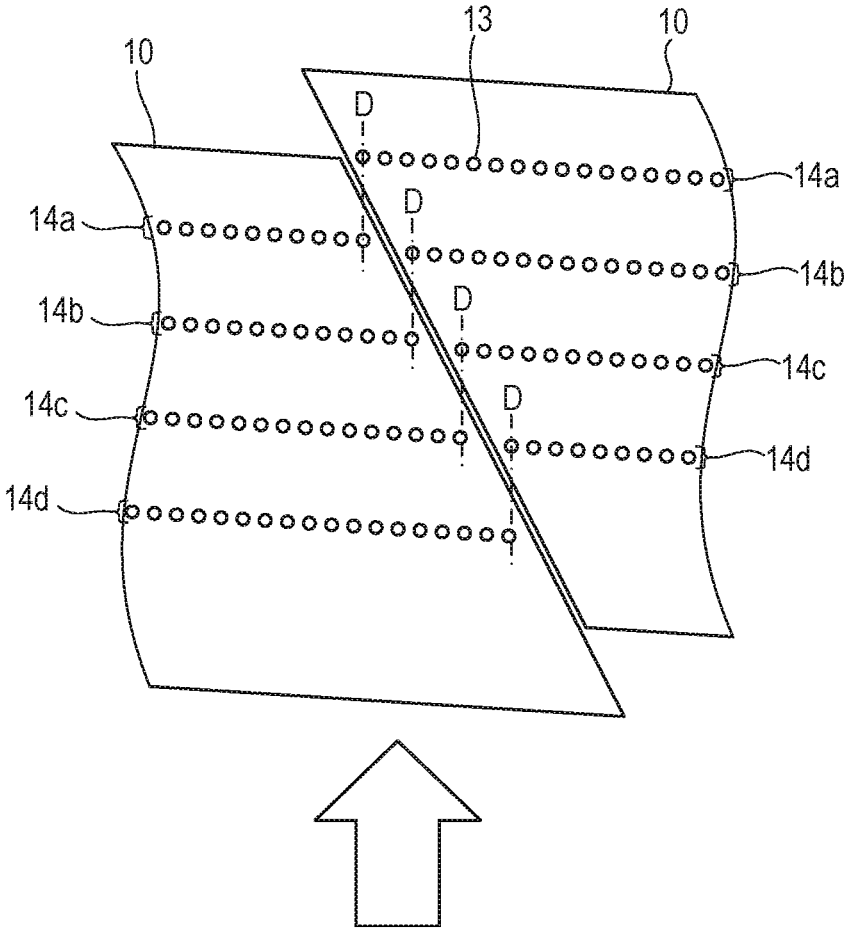
FIG. 11 is a partially enlarged plan view illustrating adjacent portions of the recording element substrates according to the first embodiment of the present disclosure.

FIG. 11 is a plan view illustrating an adjacent portion between the recording element substrates 10 in the ejection modules which are adjacent to each other by partially enlarging the adjacent portion. As illustrated in FIGS. 9A to 9C, in the present application example, the recording element substrate 10 in a substantially parallelogram shape is used. As illustrated in FIG. 11, respective election port arrays 14*a* to 14*d* in which the ejection ports 13 are arranged in the respective recording element substrates 10 are disposed so as to incline at fixed angles relative to a conveying direction of the recording medium. Thereby, in the ejection arrays in the adjacent portion of the recording element substrates 10, at least one ejection port overlaps in the conveying direction of the recording medium. In FIG. 11, two ejection ports on line D overlap each other. By disposition like this, even when the position of the recording element substrate 10 deviates from a predetermined position to some degree, a black streak and a white patch in the recorded image can be made less noticeable by drive control of the ejection ports which overlap each other. A plurality of recording element substrates 10 may be disposed rectilinearly (in line) instead of being arranged in a staggered fashion. In this case, by the structure as in FIG. 11, a black streak and a white patch in the connection portion of the recording element substrates 10 can be suppressed while increase in the length of the liquid ejection head 3 in the conveying direction of the recording medium is suppressed. Note that in the present application example, the main plane of the recording element substrate 10 is in a parallelogram shape, but the main plane is not limited to this, and even when the recording element substrate 10 in a rectangle shape, a trapezoid shape or another shape is used, the construction of the present disclosure can be preferably applied.

Figure 12:
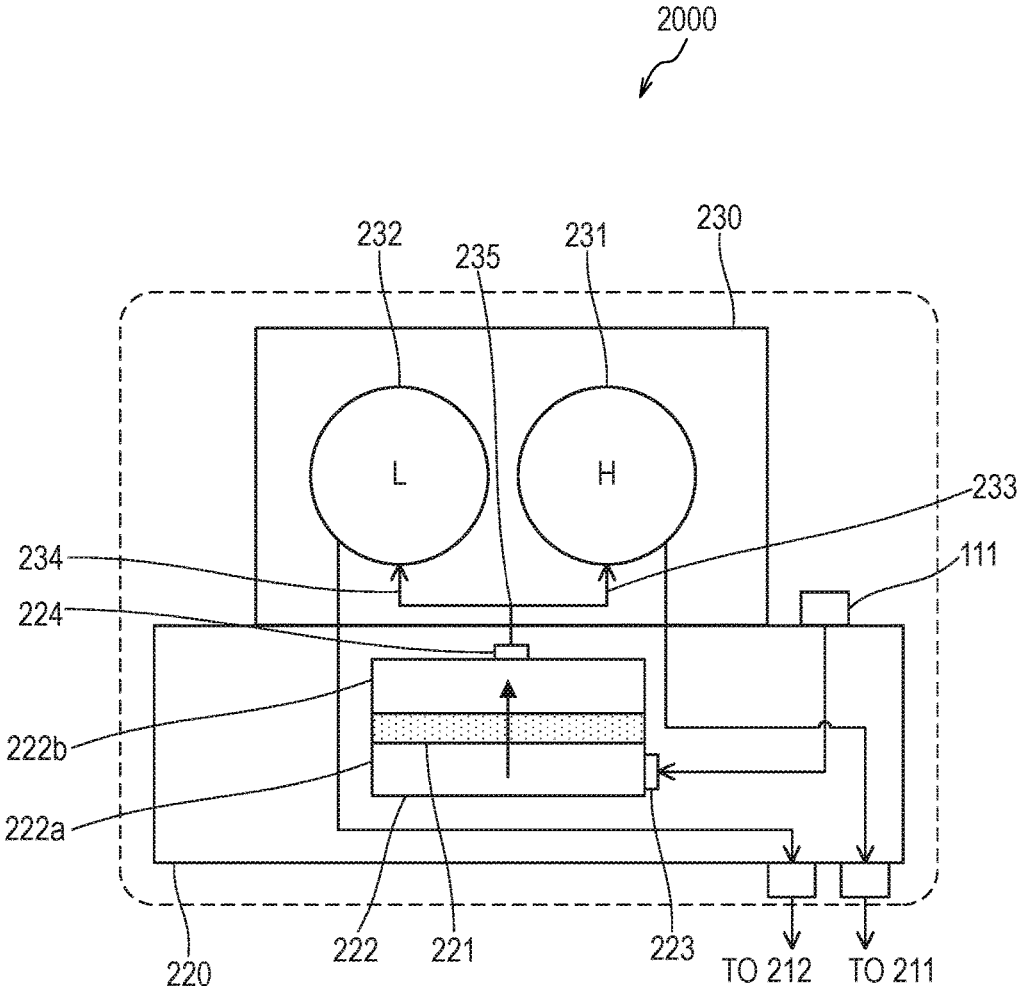
FIG. 12 is a schematic view illustrating a liquid supply assembly according to the first embodiment of the present disclosure.

FIG. 12 is a schematic view illustrating a liquid supply assembly in the present embodiment. A liquid supply assembly 2000 illustrated in FIG. 12 is constructed by the liquid supply unit 220 and the negative pressure control unit 230 illustrated in FIG. 2 and FIG. 4.

As illustrated in FIG. 12, the liquid supply unit 220 includes a filter storage chamber 222 that stores the filter 221 therein. The filter storage chamber 222 is divided into an upstream chamber 222*a* located at an upstream side from the filter 221, and a downstream chamber 222*b* located at a downstream side from the filter 221. In the present embodiment, the filter storage chamber 222 is provided to intersect (more specifically, orthogonal to) the vertical direction, and is disposed so that the liquid flows from below to above with respect to the filter 221, in a use state in which the liquid ejection head 3 is used. Consequently, the upstream chamber 222*a* is located on a lower part of the filter 221 and the downstream chamber 222*b* is located on an upper part of the filter 221.

The filter storage chamber 222 communicates with an inlet flow path 223 that supplies a liquid to the filter storage chamber 222, and an outlet flow path 224 that discharges the liquid in the filter storage chamber 222. More specifically, the inlet flow path 223 communicates with the upstream chamber 222*a*, and the outlet flow path 224 communicates with the downstream chamber 222*b*.

The inlet flow path 223 communicates with the liquid connection section 111 which is connected to the liquid supply system of the recording apparatus 1000. The outlet flow path 224 is desirably disposed at the upper part of the filter storage chamber 222 as illustrated.

Further, the negative pressure control unit 230 includes pressure adjusting mechanisms 231 and 232 as the two pressure regulating mechanisms illustrated in FIG. 2. The pressure adjusting mechanism 231 is a first pressure adjusting mechanism communicating with the common supply flow path 211 illustrated in FIG. 2, and the pressure adjusting mechanism 232 is a second pressure adjusting mechanism communicating with the common collection flow path 212 illustrated in FIG. 2. That is, the pressure adjusting mechanism 231 is a mechanism at a relatively high-pressure set side, and the pressure adjusting mechanism 232 is a mechanism at a relatively low-pressure set side. Consequently, the pressure adjusting mechanisms 231 and 232 are designed so that pressure adjusted in the pressure adjusting mechanism 231 is higher than pressure adjusted in the pressure adjusting mechanism 232. Note that the pressure adjusting mechanisms 231 and 232 adjust pressure of the same kind of liquid (ink of the same color).

An upstream flow path 233 that is a first upstream flow path that supplies a liquid to the pressure adjusting mechanism 231 communicates with the pressure adjusting mechanism 231, and an upstream flow path 234 that is a second upstream flow path that supplies a liquid to the pressure adjusting mechanism 232 communicates with the pressure adjusting mechanism 232. The upstream flow paths 233 and 234 communicate with each other by a connection section 235 that is provided at an opposite side from the pressure adjusting mechanisms 231 and 232. Lengths and sectional areas of the upstream flow path 233 and the upstream flow path 234 are desirably substantially the same.

The connection section 235 communicates with the outlet flow path 224 of the filter storage chamber 222. It is desirable that the connection section 235 is provided in vicinities of the pressure adjusting mechanisms 231 and 232, that is, provided closer to the pressure adjusting mechanism 231 and 232 than the filter 221. In other words, it is desirable that respective flow path lengths between the connection section 235 and the pressure adjusting mechanism 231, and between the connection section 235 and the pressure adjusting mechanism 232, are made shorter than a flow path length between the connection section 235 and the filter 221. Further, it is desirable that flow path lengths between the filter 221 and the pressure adjusting mechanisms 231 and 232 are as short as possible.

By the above structure, in the liquid supply assembly 2000, the liquid which is supplied to the liquid connection section 111 is supplied to the upstream chamber 222*a* of the filter storage chamber 222 via the inlet flow path 223. The liquid which is supplied to the upstream chamber 222*a* flows to above from below with respect to the filter 221 to be supplied to the downstream chamber 222*b*, and is further supplied to the connection section 235 via the outlet flow path 224. The liquid which is supplied to the connection section 235 is branched into the upstream flow paths 233 and 234. The liquid which is branched into the upstream flow path 233 is supplied to the common supply flow path 211 illustrated in FIG. 2 via the pressure adjusting mechanisms 231, and the liquid branched into the upstream flow path 234 is supplied to the common supply flow path 211 illustrated in FIG. 2 via the pressure adjusting mechanism 232.

As described above, according to the present embodiment, the connection section 235 which provides communication between the upstream flow path 233 communicating with the pressure adjusting mechanism 231 and the upstream flow path 234 communicating with the pressure adjusting mechanism 232 is provided at the downstream side of the filter 221 with respect to the flowing direction of the liquid. Accordingly, it becomes possible to make the filter 221 common for the pressure adjusting mechanisms 231 and 232, so that it becomes possible to reduce the difference of the influences of the pressure loss occurring due to the filter 221 onto the pressure adjusting mechanisms 231 and 232. Consequently, it becomes possible to stabilize control of the pressure adjusting mechanism 232, and it becomes possible to suppress a variation in the flow velocity of the liquid that flows to the ejection port 13. Further, it is not necessary to provide a plurality of filters 221, so that upsizing of the filter 211 and downsizing of the liquid ejection head 3 can be realized.

Further, in the present embodiment, the lengths of the upstream flow paths 233 and 234 are substantially the same, so that it becomes possible to reduce the difference of pressure losses that occur in the upstream flow paths 233 and 234, and therefore, it becomes possible to stabilize control of the pressure adjusting mechanism 232 more.

Further, in the present embodiment, the connection section 235 is provided closer to the pressure adjusting mechanisms 231 and 232 than the filter 221. Consequently, it becomes possible to shorten the lengths of the upstream flow paths 233 and 234, so that it becomes possible to reduce the difference of the pressure losses that occur in the upstream flow paths 233 and 234. Accordingly, it becomes possible to stabilize control of the pressure adjusting mechanisms 231 and 232 more.

Further, in the present embodiment, the liquid flows toward above from below with respect to the filter 221. In this case, air bubbles included in the liquid move upward by buoyancy, so that the air bubbles are easily discharged. Consequently, it becomes possible to restrain air bubbles from staying in the filter storage chamber 222. Thereby, the filter 221 can be restrained from being covered with air bubbles, so that it becomes possible to suppress a variation in an effective area of the filter 221, and it becomes possible to stabilize a value of the pressure loss by the filter 221. Note that the effective area of the filter 221 is an area of a portion capable of passing the liquid in the filter 221.

Second Embodiment

Figure 13:
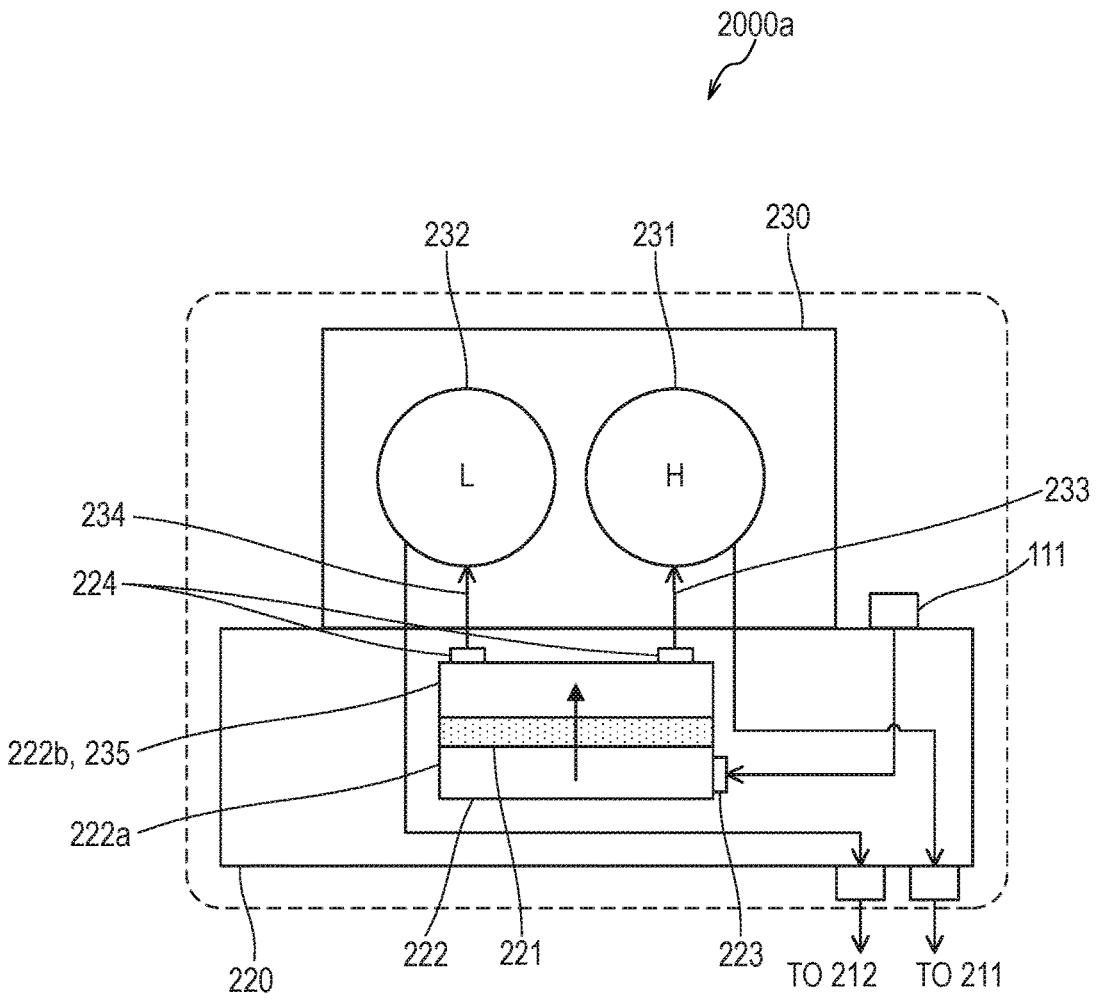
FIG. 13 is a schematic view illustrating a liquid supply assembly according to a second embodiment of the present disclosure.

FIG. 13 is a view illustrating a liquid supply assembly of the present embodiment. A liquid supply assembly 2000*a* of the present embodiment illustrated in FIG. 13 differs in the following point as compared with the liquid supply assembly 2000 of the first embodiment illustrated in FIG. 12. That is, in the present embodiment, the connection section 235 that causes the upstream flow paths 233 and 234 supplying the liquid to the respective pressure adjusting mechanisms 231 and 232 to communicate with each other is constructed by a downstream chamber 222*b* of the filter storage chamber 222.

In this case, it becomes possible to provide the upstream flow paths 233 and 234 rectilinearly, so that pressure losses that occur in the upstream flow paths 233 and 234 can be reduced, and a difference in pressure loss due to a dimensional difference of the upstream flow paths 233 and 234 can be further reduced.

In the respective embodiments described above, the illustrated structure is only an example, and the present disclosure is not limited by the structure.

According to the present disclosure, the connection section which provides communication between the first upstream flow path communicating with the first pressure adjusting mechanism and the second upstream flow path communicating with the second pressure adjusting mechanism is provided at the downstream side of the filter. Accordingly, it becomes possible to make the filter common for the first and second pressure adjusting mechanisms, so that it becomes possible to reduce the difference between the influences of the pressure loss occurring in the filter onto the first and second pressure adjusting mechanisms. Accordingly, it becomes possible to stabilize control of the first and second pressure adjusting mechanisms, and it becomes possible to suppress a variation in the flow velocity of the liquid which flows into the ejection port.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-131777, filed Jul. 5, 2017, which is hereby incorporated by reference herein in its entirety.

What is claimed is:

1. A liquid ejection head, comprising:

an element substrate including an ejection port ejecting a liquid;

a supply flow path that supplies a liquid to the element substrate;

a collection flow path that collects a liquid from the element substrate;

a first pressure adjusting mechanism that communicates with the supply flow path, and adjusts a pressure of a liquid flowing in the supply flow path;

a second pressure adjusting mechanism that communicates with the collection flow path and adjusts a pressure of a liquid flowing in the collection flow path;

a filter storage chamber including therein a filter that captures foreign matter included in a liquid;

a first upstream flow path that communicates with the first pressure adjusting mechanism, and supplies a liquid to the first pressure adjusting mechanism;

a second upstream flow path that communicates with the second pressure adjusting mechanism and supplies a liquid to the second pressure adjusting mechanism; and a connection section that causes the first upstream flow path and the second upstream flow path to communicate with each other, wherein the connection section is provided at a downstream side from the filter.

2. The liquid ejection head according to claim 1, wherein lengths of the first upstream flow path and the second upstream flow path are substantially same.

3. The liquid ejection head according to claim 1, wherein respective flow path lengths between the connection section and the first pressure adjusting mechanism, and between the connection section and the second pressure adjusting mechanism are shorter than a flow path length between the connection section and the filter.

4. The liquid ejection head according to claim 1, wherein the filter storage chamber has an upstream chamber at an upstream side from the filter and a downstream chamber at a downstream side from the filter, and the connection section is the downstream chamber.

5. The liquid ejection head according to claim 4, wherein in a use state, the filter is provided to intersect a vertical direction, and the liquid flows to above from below with respect to the filter.

6. The liquid ejection head according to claim 1, wherein a plurality of the element substrates are included, and the supply flow path and the collection flow path are provided commonly to the plurality of the element substrates.

7. The liquid ejection head according to claim 6, wherein the plurality of the element substrates are provided rectilinearly along a longitudinal direction of the liquid ejection head.

8. The liquid ejection head according to claim 1, wherein the element substrate includes an ejection port array in which the ejection port is arranged, a pressure chamber including therein a recording element generating energy for ejecting the liquid, a liquid supply path that supplies the liquid to a plurality of the pressure chambers, and extends along the ejection port array, and a liquid collection path that collects the liquid from the plurality of the pressure chambers and extends along the ejection port array.

9. The liquid ejection head according to claim 8, wherein the liquid is supplied in order of the filter storage chamber, the first pressure adjusting mechanism, the supply flow path, the liquid supply path and the pressure chamber.

10. The liquid ejection head according to claim 8, wherein the liquid is supplied in order of the filter storage chamber, the second pressure adjusting mechanism, the collection flow path and the liquid collection path.

11. The liquid ejection head according to claim 8, wherein the liquid is supplied in order of the filter storage chamber, the first pressure adjusting mechanism, the supply flow path, the liquid supply path, the pressure chamber, the liquid collection path and the collection flow path.

12. The liquid ejection head according to claim 1, further comprising a pressure chamber including therein a recording element generating energy to eject the liquid, wherein the liquid in the pressure chamber is circulated between the pressure chamber and an outside via the supply flow path and the collection flow path.

* * * * *